US005777552A

United States Patent [19]

Fischette et al.

[11] Patent Number: 5,777,552

[45] Date of Patent: Jul. 7, 1998

[54] CURTAIN DOOR ALARM

[75] Inventors: Robert G. Fischette; Scot R. Newport, both of Portland, Oreg.

[73] Assignee: Sentrol, Inc., Tualatin, Oreg.

[21] Appl. No.: 510,460

[22] Filed: Aug. 2, 1995

[51] Int. Cl.[6] ..... G08B 13/08

[52] U.S. Cl. ..... 340/547; 335/206

[58] Field of Search ..... 340/547, 545; 335/207, 206, 205; 200/61.62, 61.67, 61.71, 61.72, 61.73

[56] References Cited

U.S. PATENT DOCUMENTS

| | | | |
|---|---|---|---|
| 2,877,361 | 3/1959 | Chase | 340/547 |
| 3,596,021 | 7/1971 | Saul | 335/205 |
| 3,710,369 | 1/1973 | Takahashi | 340/547 |
| 3,828,340 | 8/1974 | Bauer, Jr. et al. | 340/547 |
| 4,232,309 | 11/1980 | Dillitzer | 340/547 |
| 4,271,338 | 6/1981 | Rakocy | 340/547 |
| 5,402,106 | 3/1995 | DiPaolo et al. | 340/547 |
| 5,422,628 | 6/1995 | Rodgers | 335/206 |
| 5,442,865 | 8/1995 | Wallrafen | 33/708 |

FOREIGN PATENT DOCUMENTS

| | | | |
|---|---|---|---|
| 2187890 | 9/1987 | United Kingdom | 335/206 |

*Primary Examiner*—Jeffery Hofsass
*Assistant Examiner*—Sihong Huang
*Attorney, Agent, or Firm*—Stoel Rives LLP

[57] ABSTRACT

A magnetic alarm sensor (80) includes a magnet (84) positioned so that dominant length components (108) of its magnetic field lines (104) are oriented so that they are transverse to a switch axis (96) of a magnetically sensitive switch (88). This orientation permits more versatile mounting options for placement of the alarm sensor, especially to positions that are less prone to displacements over time. A preferred embodiment of the magnetic alarm sensor (110) employs two spatially collinear magnetic switches (116, 118) vertically oriented along a door bracket (14) and a magnet (120) positioned on a door panel (22) such that the magnetic field lines (152) of the magnet are generally perpendicular to the switch axis (136) of the magnetic switches. The magnetic switches are electrically connected in parallel to extend the range of vertical critical distance between the magnet and the magnetic switches to inhibit false alarms caused by door sag.

12 Claims, 3 Drawing Sheets

CURTAIN DOOR ALARM

TECHNICAL FIELD

The invention relates to magnetic alarm sensors and, in particular, to a method and an apparatus employing a magnetic switch that is responsive to the proximity of a magnetic field oriented generally perpendicular to a longitudinal axis of the magnetic switch.

BACKGROUND OF THE INVENTION

The background is presented herein only by way of example to magnetic alarm sensors for securing curtain door assemblies. FIG. 1 depicts a conventional curtain door assembly 10 as viewed from the interior of a room. Curtain door assembly 10 includes a segmented or "curtain" door 12 positioned between a pair of opposing, U-shaped door brackets 14, each having an end 16 and two sides 18 that form a channel 20.

A typical door 12 has about twenty contiguous, horizontally hinged, horizontal panels 22 that each have a length 24 sufficiently long to extend into channels 20 and have a width 26 sufficiently short to allow door 12 to be easily rolled up into a tubular housing 28 and around an internal roller (not shown). Door 12 also has a floor panel 30 that is horizontally hinged to a bottom horizontal panel **22*b*. The length of floor panel 30 is less than that of panels 22 so that it can be extended into the room beyond sides 18 of door bracket 14 and aligned generally perpendicular to panels 22. Floor panel 30 may rest flat against a floor 32, be suspended slightly above and generally parallel to floor 32, or drop at an angle from bottom panel 22*b* so that an unhinged end 34 of floor panel 30 contacts floor 32. Door 12 may be manually or automatically raised or lowered through a force applied to a chain 36** that activates the roller.

FIG. 2 is a fragmentary isometric view of curtain door assembly 10 equipped with a conventional magnetic alarm system 40 that includes an alarm sensor 42, and FIG. 3 is an enlarged sectional side elevation view of alarm sensor 42. With reference to FIGS. 2 and 3, alarm sensor 42 includes a bar magnet 44 that is encased inside of a door mounting bracket 46 and a magnetic switch 48 that is encased inside of a floor mounting bracket 50. Floor mounting bracket 50 is mounted to floor 32 and positioned so that the length of mounting bracket 50 is adjacent and generally parallel to unhinged end 34 of floor panel 30, typically in the vicinity of door bracket 14. Door mounting bracket 46 is mounted to floor panel 30 so that length 47 of magnet 44 is positioned parallel to, and in the same vertical plane as that of, magnetic switch 48 such that door mounting bracket 46 rests on top of, or is supported over, floor mounting bracket 50.

FIG. 4 is a simplified representation of the prior art alignment between magnetic switch 48 and magnet 44 and its associated magnetic field 52 characterized by magnetic field lines 54. With reference to FIG. 4, magnet switch 48 includes a pair of overlapping, but nonattached ferromagnetic filaments 56 that form part of contacts 58 having terminals 60 connected to different terminals of an electrical circuit (not shown). Filaments 56 and contacts 58 are aligned generally along a switch axis 62. Magnet 44 has opposite poles 64 and 66 that are aligned generally along a magnetic axis 68. Magnetic field lines 54 include end components 70 respectively originating from or terminating in magnetic poles 64 and 66. End components 70 are portions of magnetic field 52 that extend outwardly beyond magnet length 47 and magnetic poles 64 and 66. Magnetic field lines 54 also include dominant length components 72 that are portions of magnetic field 52 that are generally parallel to magnetic axis 68 and do not generally extend beyond magnet length 47 and magnetic poles 64 and 66.

With reference to FIGS. 2–4, magnet 44 and magnet switch 48 are mounted so that magnetic axis 68 is positioned generally within the same vertical X-Y plane (i.e., the plane of a closed door 12) as switch axis 62, and such that dominant length components 72 of magnetic field lines 54 are generally parallel to switch axis 62.

Whenever magnet 44 is positioned at a distance that is shorter than a critical distance from magnetic switch 48, filaments 56 interact with magnetic field 52 and assume a nonalarm state; and whenever magnet 44 is moved to a distance that is longer than the critical distance, filaments 56 do not interact with magnet field 52 and assume an alarm state. Thus, whenever floor panel 30 is moved away (i.e., upward in the X-Y plane or sideways in the X-Z plane) from alarm sensor 42, the circuitry directly or indirectly connected to contacts 58 indicates a breach of door 12. Skilled persons will note that in FIG. 4, filaments 56 are depicted in a contacting 30 or closed state in the presence of magnetic field 52 and therefore, the contacting state indicates a closed or secure door 12.

The conventional curtain door alarm systems 40 are easily misaligned and prone to indicate false alarms. Curtain doors 12 are often impacted by vehicles such that brackets become bent and/or panels 22 become dented. Doors 12 also tend to sag over time and from numerous impacts. These incidents may displace magnet 44 either horizontally along an X or a Z axis of an X-Z plane or vertically along the X-Y plane such that magnet 44 is moved beyond the critical distance from magnetic switch 48. Such incidents would cause filaments 56 to assume an alarm state and trigger alarm sensor 42 to falsely indicate a breach of door 12.

False alarms are not appreciated by neighboring businesses, residents, monitoring/alarm response services, and local police. The position of floor mounting bracket 50 on floor 32 and/or the position of door mounting bracket 46 on door 12 must be constantly adjusted in an attempt to minimize false alarms.

SUMMARY OF THE INVENTION

An object of the present invention is, therefore, to provide an alarm system that is less susceptible to generating a false alarm.

Another object of the present invention is to provide such a system including an alarm switch that is responsive to the proximity of a magnetic field.

The present invention employs an alarm sensor that includes a magnet characterized by magnetic field lines having end components and dominant length components. The magnet is positioned so that the dominant length components are oriented transverse or perpendicular to a longitudinal axis of a magnetically sensitive switch. This orientation permits more versatile mounting options for placement of the alarm sensor, especially to positions on a curtain door that are less prone to displacements over time.

A preferred embodiment of the present invention employs two electrically parallel-connected, spatially collinear magnetic switches that are vertically oriented along a door bracket, and a magnet positioned on a door panel such that the dominant length components of the magnetic field lines of the magnet are aligned transverse and more preferably generally perpendicular to the magnetic switches. The magnetic switches are electrically parallel-connected and spatially collinear to provide a vertically extended range of critical distance that provides sufficient magnetic field interaction between the magnet and the magnetic switches to inhibit false alarms caused by door sag.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
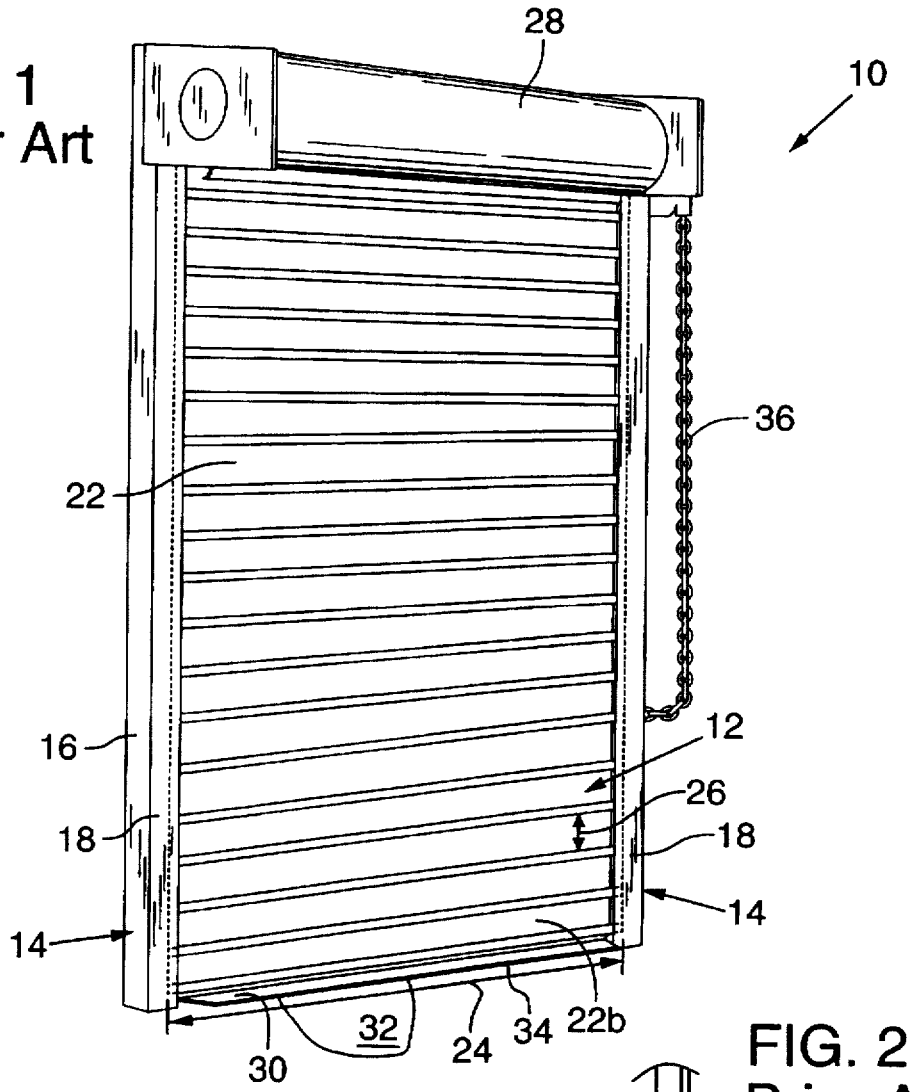
FIG. 1 Prior Art
FIG. 1 is an isometric view of an interior side of a conventional curtain door assembly.
Figure 3:
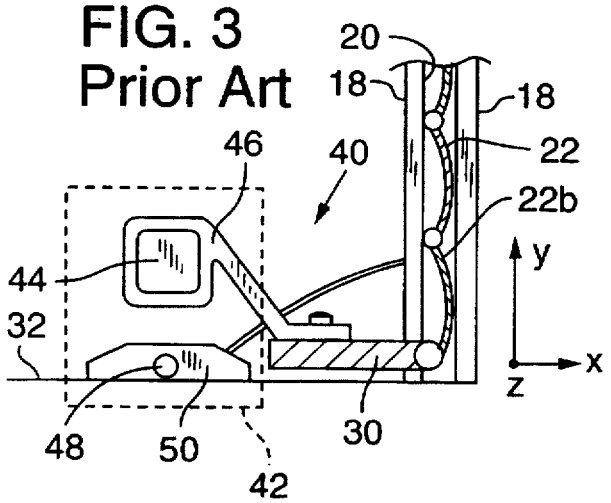
FIG. 3 Prior Art
FIG. 3 is an enlarged sectional, side elevation view of a prior art magnetic alarm sensor forming part of the magnetic alarm system depicted in FIG. 2.
Figure 2:
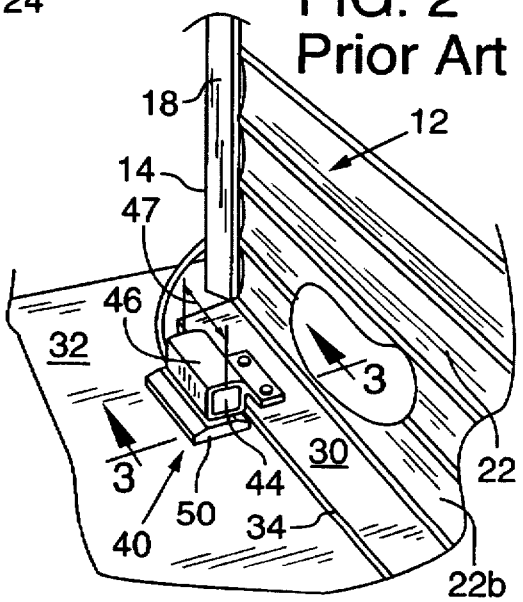
FIG. 2 Prior Art
FIG. 2 is a fragmentary isometric view of an interior side of a conventional curtain door assembly of FIG. 1 equipped with a prior art magnetic alarm system.
Figure 4:
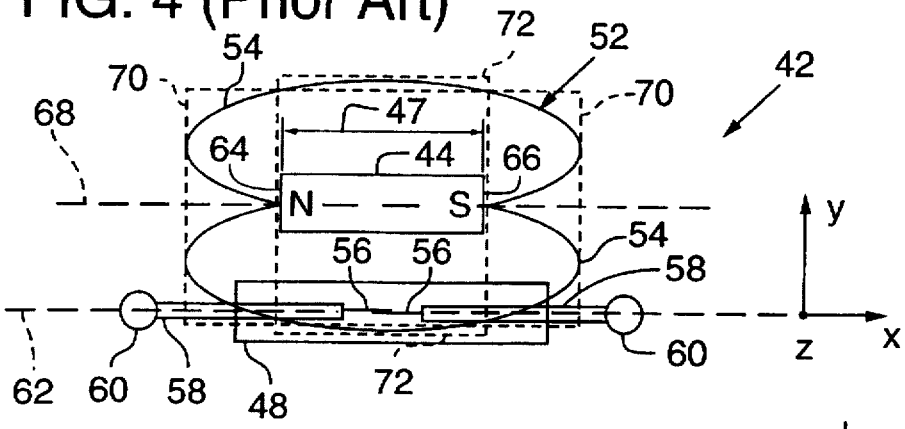
FIG. 4 (Prior Art)
FIG. 4 is a simplified representation of a typical magnetic reed switch, magnet, and associated magnetic field lines that form part of the prior art magnetic alarm sensor of FIG. 3.
Figure 5:
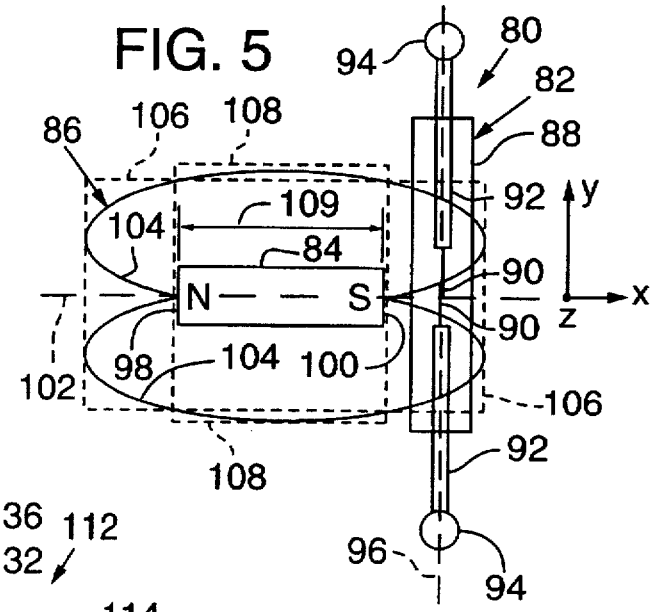
FIG. 5 is a simplified diagram of an embodiment of an alarm sensor of the present invention.

FIG. 5 is a diagram showing a preferred embodiment of an alarm sensor 80 having a detector 82 and a bar magnet 84 with an associated magnetic field 86, all of which are positioned within an X-Y-Z coordinate axis system. With reference to FIG. 5, detector 82 includes a magnetic switch 88 having a pair of overlapping, but nonattached ferromagnetic filaments 90 that form part of electrical contacts 92 with terminals 94 connected to different terminals of an electrical circuit (not shown). The filaments 90 and contacts 92 are generally collinear and preferably vertically aligned along a switch axis 96 within an X-Y plane.

Magnet 84 has respective opposite north and south poles 98 and 100 that are generally aligned along a magnetic axis 102 that lies generally horizontally within the X-Y plane. Magnetic field 86 is characterized by magnetic field lines 104 having end components 106 and dominant length components 108. End components 106 are portions of magnetic field 86 that originate from or terminate in magnetic poles 98 and 100 and extend outwardly beyond magnet length 109 and magnetic poles 98 and 100. Dominant length components 108 are portions of magnetic field 86 that are generally parallel to magnetic axis 102 and do not generally extend beyond magnet length 109. Magnetic switch 88 and magnet 84 are mounted so that switch axis 96 is positioned generally perpendicular to magnetic axis 102 and dominant length components 108 of magnetic field lines 104.

Whenever magnet 84 is positioned at a distance that is shorter than a critical distance from magnetic switch 88, filaments 90 interact with magnetic field 86 and assume a nonalarm state; and whenever magnet 84 is moved to a distance longer than the critical distance, filaments 90 do not interact with magnetic field 86 and assume an alarm state. Skilled persons will appreciate that the size or strength of magnetic field 86 determines the critical minimum distance between magnet 84 and magnetic switch 88 that causes magnetic field 86 interact with filaments 90.

Skilled persons will note that in FIG. 5, filaments 90 are depicted in a contacting or closed state in the presence of magnetic field 86. Accordingly, in this embodiment the contacting state indicates a closed or secure door 12 and a noncontacting state would indicate a breach of door 12. Skilled persons will appreciate that certain types of magnetic switches may employ filaments that remain contacting unless they are in the presence of a magnetic field. Such switches would, therefore, indicate an alarm state whenever the filaments were contacting.

Figure 6:
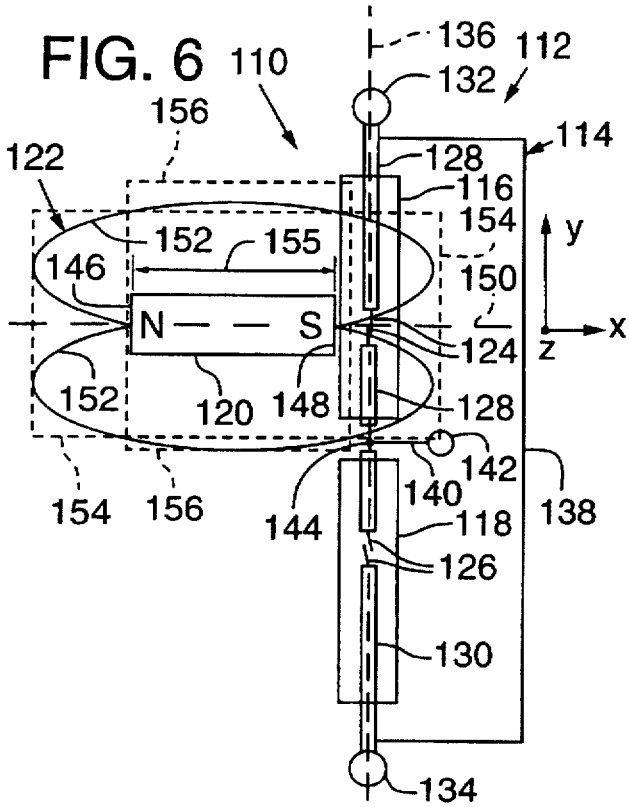
FIG. 6 is a simplified, partly schematic diagram of a preferred embodiment having two spatially collinear magnetic switches.

FIG. 6 is a diagram showing another preferred embodiment of an alarm sensor 110 including a detector 112, having a switch circuit 114 with two magnetic switches 116 and 118, and a bar magnet 120 with associated magnetic field 122, all of which are positioned within an X-Y-Z coordinate axis system. With reference to FIG. 6, magnetic switches 116 and 118 each include a pair of overlapping, but nonattached ferromagnetic filaments 124 and 126 that form part of contacts 128 and 130 having terminals 132 and 134, respectively.

Figure 7:
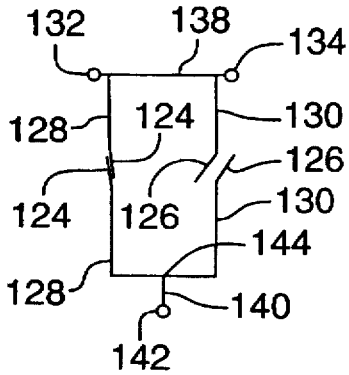
FIG. 7 is an electrical circuit diagram of the spatially collinear magnetic switches of FIG. 6.

In switch circuit 114, the filaments 124 and 126 and contacts 128 and 130 are generally collinearly spatially aligned along a switch axis 136 within a vertical X-Y plane. Terminals 132 and 134 are electrically connected by a wire 138; and a contact 140 having a terminal 142 is electrically connected at a junction node 144 between magnetic switches 116 and 118. Terminal 142 and either one of terminals 132 or 134 are connected to different terminals of any electrical circuit (not shown) such that magnetic switches 116 and 118 are electrically connected in parallel, as shown in FIG. 7.

Magnet 120 has respective opposite north and south poles 146 and 148 that are aligned generally along a magnetic axis 150 within a horizontal X-Z plane. Magnetic field 122 is characterized by magnetic field lines 152 having end components 154 and dominant length components 156. End components 154 are portions of magnetic field 122 that originate from or terminate in magnetic poles 146 and 148 and extend outwardly beyond magnet length 155 and magnetic poles 146 and 148. Dominant length components 156 are portions of magnetic field 122 that are aligned generally parallel to magnetic axis 150 and do not generally extend beyond magnet length 155. Magnet 120 is mounted so that magnetic axis 150 is positioned generally transverse and preferably perpendicular to switch axis 136 so that dominant length components 156 of magnetic field lines 152 are generally transverse and preferably perpendicular to switch axis 136.

Whenever magnet 120 is positioned at a distance that is shorter than a critical distance from magnetic switch 116 or 118, the respective filaments 124 or 126 assume a nonalarm state; and whenever magnet 120 is moved to a distance longer than the critical distance, filaments 124 or 126 assume an alarm state. Skilled persons will note that in FIG. 6 filaments 124 of magnetic switch 116 are shown in a contacting or closed state in the presence of magnetic field 122, and filaments 126 of magnetic switch 118 are shown in a noncontacting or open state in the absence of magnetic field 122. Skilled persons will appreciate that magnetic switches may alternatively employ filaments that become contacting only in the absence of a magnetic field.

Magnetic switches 116 and 118 are electrically connected in parallel to extend the range of vertical critical distance between magnet 120 and detector 112. Magnetic switches 116 and 118 are positioned sufficiently close to each other such that magnet 120 will activate at least one of switches 116 or 118 whenever the magnet 120 is moved vertically alongside switch axis 136 from one switch to the other. This electrically parallel-connected, spatially collinear arrangement of magnetic switches 116 and 118 in detector 112 permits detector 112 to assume an alarm state only whenever both magnetic switches 116 and 118 assume an alarm state.

This arrangement provides alarm sensor 110 with sufficient range of interaction between magnetic field 122 and detector 112 to inhibit false alarms that might otherwise result from, for example, chronic sagging of, or incidental nonbreach impacts with, curtain door 12. The embodiment shown in FIG. 6 provides about twice the range of critical distance than that provided by the embodiment shown in FIG. 5.

Figure 8:
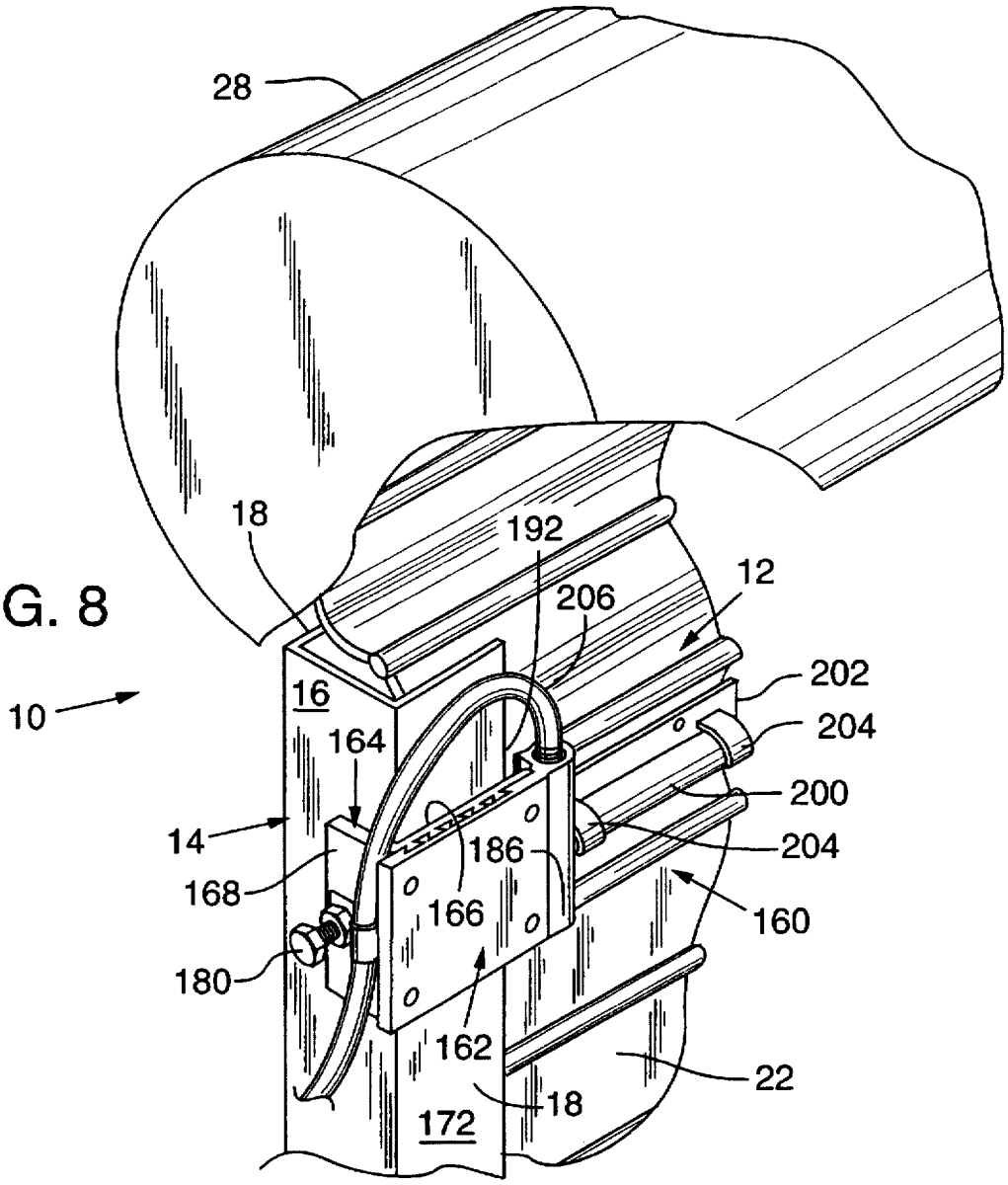
FIG. 8 is an isometric fragmentary view of the alarm sensor embodiment shown in FIG. 6 that is encased in mounting brackets and mounted to a curtain door assembly.
Figure 9:
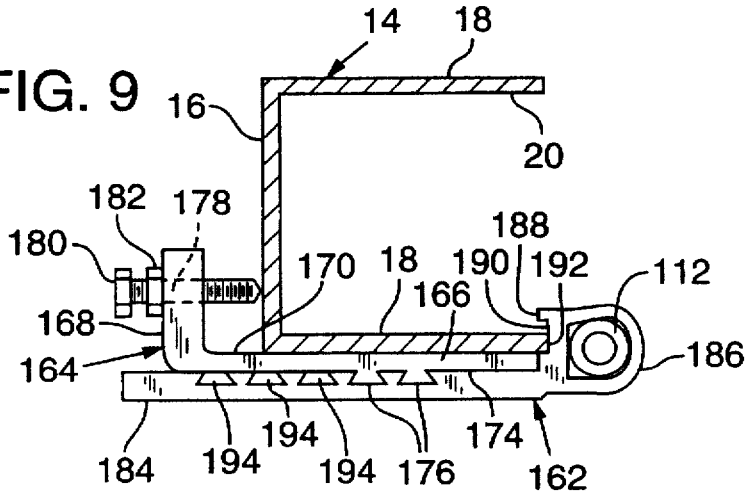
FIG. 9 is a plan sectional view of the door bracket and magnetic switch mounting bracket shown in FIG. 8.

FIG. 8 shows an alarm system 160 that includes alarm sensor 80 (FIG. 5) or 110 (FIG. 6) mounted to door assembly 10. For convenience, the following description will proceed with reference to alarm sensor 110 (FIG. 6) and its components, as well as with reference to door assembly 10 and its components. Alarm system 160 includes a switch housing 162 and an "L"-shaped adjustable bracket 164 having a side segment 166 and an end segment 168. FIG. 9 shows a plan view of switch housing 162 and adjustable bracket 164 as connected to door bracket 14. With reference to FIGS. 8 and 9, side segment 166 preferably includes an inner flat surface 170 adapted for close contact with side surface 172 of side 18 of door bracket 14, and an outer surface 174 with two dovetail interlocks 176. End segment 168 includes a hole 178 adapted to receive mounting bolt 180 that cooperates with lock nut 182 to adjust the distance between door bracket end 16 and end segment 168.

Switch housing 162 has a side segment 184 and a switch casing 186 attached to inner securing lip 188 to form bracket groove 190 that is adapted to receive tip 192 of side 18 of door bracket 14. Side segment 184 has multiple recesses 194 adapted to fit snuggly about interlocks 176. Interlocks 176 may be secured in different recesses 194 along the length of side segment 184 so that switch housing 162 can be adjusted to fit a door bracket 18 with a wide range of lengths of side 18. Mounting bolt 180 can then be tightened to secure lip 188 about tip 192.

Magnet housing 200 encloses magnet 120 and is held in magnet bracket 202 by magnet supports 204. Magnet bracket 202 is mounted to horizontal panel 22 such that magnet axis 150 of magnet 120 is generally perpendicular to switch axis 136 of detector 112, as previously described. Skilled persons will appreciate that the width or thickness of magnet 120 is preferably adapted to fit within the height of horizontal panel 22 so that magnet 120 may be easily rolled up into an internal roller (not shown).

Alarm sensor 110 is preferably mounted at a height that is several feet above floor 32, and most preferably mounted in an upper interior corner of door assembly 10. One advantage of this "off-the-floor" positioning is that alarm sensor 110 suffers less misalignment from accidental contact with, or in-out motion of lower parts of, door 12.

Wire 206 may connect alarm sensor 110 to a power supply and/or a CPU in a control panel or other components of alarm system 160. Skilled persons are familiar with known circuitry for implementing "door breach" and/or "door secure" signals. Door breach signals may result in an indicator light, a sound element (such as a siren), or a remote alert at a monitoring station. Skilled persons will also appreciate that wire 206 could be replaced, for example, with a transmitter responsive to noncontacting states of both sets of filaments 124 and 126.

It will be obvious to those having skill in the art that various changes may be made in the details of the above-described embodiments of the present invention without departing from the underlying principles thereof. For example, skilled persons will appreciate that in addition to bar-shaped magnets, horseshoe-, disk-, or other shaped magnets may be employed. The scope of the present invention should, therefore, be determined only by the following claims.

We claim:

1. A magnetic alarm sensor for a movable barrier, comprising:

a magnet that has a magnetic axis extending between opposite magnetic poles and generates a magnetic field characterized by magnetic field lines having dominant length components that are generally parallel to the magnetic axis and end components that extend outwardly beyond the magnetic poles; and a first magnetic switch having electrical contacts positioned along a switch axis, the contacts having a nonalarm state whenever the contacts interact with the magnetic field and an alarm state whenever the contacts do not interact with the magnetic field;

a second magnetic switch having electrical contacts positioned spatially collinear with the switch axis, the contacts of the second magnetic switch having a nonalarm state whenever the contacts of the second magnetic switch interact with the end components of the magnetic field and an alarm state whenever the contacts of the second magnetic switch do not interact with the end components of the magnetic field, the first and second magnetic switches being electrically connected in parallel, so that the alarm sensor assumes an alarm state whenever both sets of contacts assume an alarm state; and wherein the magnetic alarm sensor is positioned such that the magnetic axis is oriented transverse to the switch axis so that the end components of the magnetic field interact with the contacts of either the first or second switch when the movable barrier is in a closed position to assume a nonalarm state thus increasing a range of interaction between the magnetic field and the contacts to inhibit the contacts from assuming an unintentional alarm state.

2. The magnetic alarm sensor of claim 1 in which the first and second switches are adapted for being positioned such that the switch axis is generally vertical and the magnet is adapted for being positioned such that the magnetic axis is generally horizontal.

3. The magnetic alarm sensor of claim 1 in which the first and second magnetic switch comprises a reed switch.

4. The magnetic alarm sensor of claim 1 in which the magnet is adapted for mounting to a curtain door panel.

5. The magnetic alarm sensor of claim 1 in which the first and second magnetic switches and the magnet are mounted away from a floor surface.

6. A method for configuring components of a magnetic alarm sensor for a movable barrier, comprising:

providing a magnet having a magnetic axis between opposite magnetic poles and a magnetic field characterized by magnetic field lines having dominant length components that are generally parallel to the magnetic axis and end components extending outwardly beyond the magnetic poles;

configuring a first magnetic switch to have electrical contacts positioned along a switch axis, the contacts having a nonalarm state whenever the contacts interact with the end components of the magnetic field and an alarm state whenever the contacts do not interact with the end components of the magnetic field;

configuring a second magnetic switch to have electrical contacts positioned spatially collinear with the switch axis, the contacts of the second magnetic switch having a nonalarm state whenever the contacts of the second magnetic switch interact with the end components of the magnetic field and an alarm state whenever the contacts of the second magnetic switch do not interact with the end components of the magnetic field;

connecting the first and second magnetic switches electrically in parallel such that the alarm sensor assumes an alarm state whenever both sets of contacts assume an alarm state; and positioning the magnetic alarm sensor such that the magnetic axis is transverse to the switch axis so that the end components of the magnetic field interact with the contacts of either the first or second switch when the movable barrier is in a closed position to assume a nonalarm state and so that a range of critical distance in a horizontal plane is extended to inhibit false alarms.

7. The method of claim 6 further comprising:

adapting the first and second switches for positioning their axes generally vertically; and adapting the magnet for positioning the magnetic axis generally horizontally.

8. The method of claim 6 further comprising:

adapting the magnet and the first and second magnetic switches for mounting away from a floor surface.

9. The method of claim 6 in which the magnet is adapted for mounting to a curtain door panel.

10. A magnetic alarm sensor for a movable barrier, comprising:

a magnet that generates a magnetic field;

a pair of magnetic switches each having electrical contacts positioned along a common switch axis, the sensor having a nonalarm state whenever one of the contacts interacts with the magnetic field when the movable barrier is in a closed position and an alarm state when neither of the contacts interacts with the magnetic field; and an electrically parallel connection between the magnetic switches such that the alarm sensor assumes an alarm state whenever both contacts assume an alarm state, the sensor being constructed and arranged so that the range of interaction between the magnetic field and the contacts of the first and second switches is increased to prevent an unintentional alarm state.

11. The magnetic alarm sensor of claim 10, comprising:

the magnetic field characterized by opposite magnetic poles and magnetic field lines having end components that originate from or terminate in the magnetic poles and extend outwardly beyond the magnetic poles of the magnet such that one of the end components is adapted for interacting with the contacts of the pair of magnetic switches.

12. The magnetic alarm sensor of claim 11 in which the pair of switches are positioned within a predetermined distance of each other such that the magnetic field has a strength sufficient to interact with at least one of the contacts whenever the magnet is moved between the pair of switches and along the switch axis.

* * * * *